US011428443B2

(12) United States Patent
Zha et al.

(10) Patent No.: US 11,428,443 B2
(45) Date of Patent: Aug. 30, 2022

(54) THERMAL STORAGE OF CARBON DIOXIDE SYSTEM FOR POWER OUTAGE

(71) Applicant: HEATCRAFT REFRIGERATION PRODUCTS LLC, Stone Mountain, GA (US)

(72) Inventors: Shitong Zha, Snellville, GA (US); Fardis Najafifard, Decatur, GA (US); Xi Sun, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 35 days.

(21) Appl. No.: 17/010,175

(22) Filed: Sep. 2, 2020

(65) Prior Publication Data

US 2020/0400349 A1 Dec. 24, 2020

Related U.S. Application Data

(62) Division of application No. 15/667,194, filed on Aug. 2, 2017, now Pat. No. 10,767,909.

(51) Int. Cl.
*F25B 9/00* (2006.01)
*F25B 1/10* (2006.01)
(Continued)

(52) U.S. Cl.
CPC ..... *F25B 9/008* (2013.01); *F25B 1/10* (2013.01); *F25B 31/006* (2013.01); *F25B 5/02* (2013.01);
(Continued)

(58) Field of Classification Search
CPC ..... F25B 9/008; F25B 1/10; F25B 31/006; F25B 41/39; F25B 5/02; F25B 2309/06;
(Continued)

(56) References Cited

U.S. PATENT DOCUMENTS

2008/0196420 A1* 8/2008 Gernemann ..... F25B 9/008 62/509
2013/0298593 A1 11/2013 Christensen
2016/0178244 A1 6/2016 DelVentura et al.

FOREIGN PATENT DOCUMENTS

EP 2257749 A2 12/2010

OTHER PUBLICATIONS

Patenaude, A., "CO2 Booster Systems From a Service Mechanic's Perspective," Raleigh, North Carolina, Mar. 1, 2017, pp. 1-48.
(Continued)

*Primary Examiner* — Joseph F Trpisovsky
(74) *Attorney, Agent, or Firm* — Baker Botts L.L.P.

(57) ABSTRACT

A system includes a high side heat exchanger, a flash tank, a first load, a second load, and a thermal storage tank. The high side heat exchanger is configured to remove heat from a refrigerant. The flash tank is configured to store the refrigerant from the high side heat exchanger and discharge a flash gas. The first load is configured to use the refrigerant from the flash tank to remove heat from a first space proximate to the first load. The second load is configured to use the refrigerant from the flash tank to remove heat from a second space proximate to the second load. The thermal storage tank is configured, when a power outage is determined to be occurring, to receive the flash gas from the flash tank, and remove heat from the flash gas.

13 Claims, 8 Drawing Sheets

(51) Int. Cl.

| | |
|---|---|
| ***F25B 31/00*** | (2006.01) |
| *F25B 5/02* | (2006.01) |
| *F25B 41/39* | (2021.01) |

(52) U.S. Cl.
CPC ..... *F25B 41/39* (2021.01); *F25B 2309/06* (2013.01); *F25B 2400/23* (2013.01); *F25B 2500/07* (2013.01); *F25B 2600/2509* (2013.01)

(58) Field of Classification Search
CPC ..... F25B 2400/16; F25B 2400/17; F25B 2400/23; F25B 2400/24; F25B 2500/07; F25B 2600/2509
See application file for complete search history.

(56) References Cited

OTHER PUBLICATIONS

European Patent Office, Extended European Search Report, Application No. 18185616.2, dated Nov. 9, 2018, 7 pages.
European Patent Office, Communication pursuant to Article 94(3) EPC, Application No. 18185616.2, dated Aug. 28, 2019, 5 pages.
European Patent Office, Communication pursuant to Article 94(3) EPC, Application No. 18185616.2, dated Feb. 27, 2020, 5 pages.

* cited by examiner

THERMAL STORAGE OF CARBON DIOXIDE SYSTEM FOR POWER OUTAGE

CROSS-REFERENCE TO RELATED APPLICATIONS

This application is a continuation of U.S. patent application Ser. No. 15/667,194 filed Aug. 2, 2017, by Shitong Zha et al., and entitled "Thermal Storage of Carbon Dioxide System for Power Outage," which is incorporated herein by reference.

TECHNICAL FIELD

This disclosure relates generally to a cooling system.

BACKGROUND

Cooling systems cycle a refrigerant to cool various spaces. For example, a refrigeration system may cycle refrigerant to cool spaces near or around a refrigeration unit.

SUMMARY OF THE DISCLOSURE

According to one embodiment, a system includes a high side heat exchanger, a flash tank, a first load, a second load, and a thermal storage tank. The high side heat exchanger is configured to remove heat from a refrigerant. The flash tank is configured to store the refrigerant from the high side heat exchanger and discharge a flash gas. The first load is configured to use the refrigerant from the flash tank to remove heat from a first space proximate to the first load. The second load is configured to use the refrigerant from the flash tank to remove heat from a second space proximate to the second load. The thermal storage tank is configured, when a power outage is determined to be occurring, to receive the flash gas from the flash tank, and remove heat from the flash gas.

According to another embodiment, a method includes removing heat from a first space proximate to a first load using a refrigerant from a flash tank. The method also includes removing heat from a second space proximate to a second load using the refrigerant from the flash tank. The method further includes removing heat from the refrigerant using a high side heat exchanger. The method also includes storing the refrigerant from the high side heat exchanger in the flash tank. The method further includes discharging the flash gas from the flash tank. The method also includes removing heat from the flash gas using a thermal storage tank when a power outage is determined to be occurring.

According to yet another embodiment, a system includes a flash tank, a first load, a second load, and a thermal storage tank. The flash tank is configured to store a refrigerant and discharge a flash gas. The first load is configured to use the refrigerant from the flash tank to remove heat from a first space proximate to the first load. The second load is configured to use the refrigerant from the flash tank to remove heat from a second space proximate to the second load. The thermal storage tank is configured, when a power outage is determined to be occurring, to receive a flash gas from the flash tank and remove heat from the flash gas.

Certain embodiments may provide one or more technical advantages. For example, an embodiment may use a thermal storage tank to keep flash gas and refrigerant in the system cool during a power outage. As a result, the thermal storage tank may minimize loss of refrigerant from the cooling system when the system is without power. In some embodiments, the cooling system may remove heat from the thermal storage tank when the cooling system has power. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
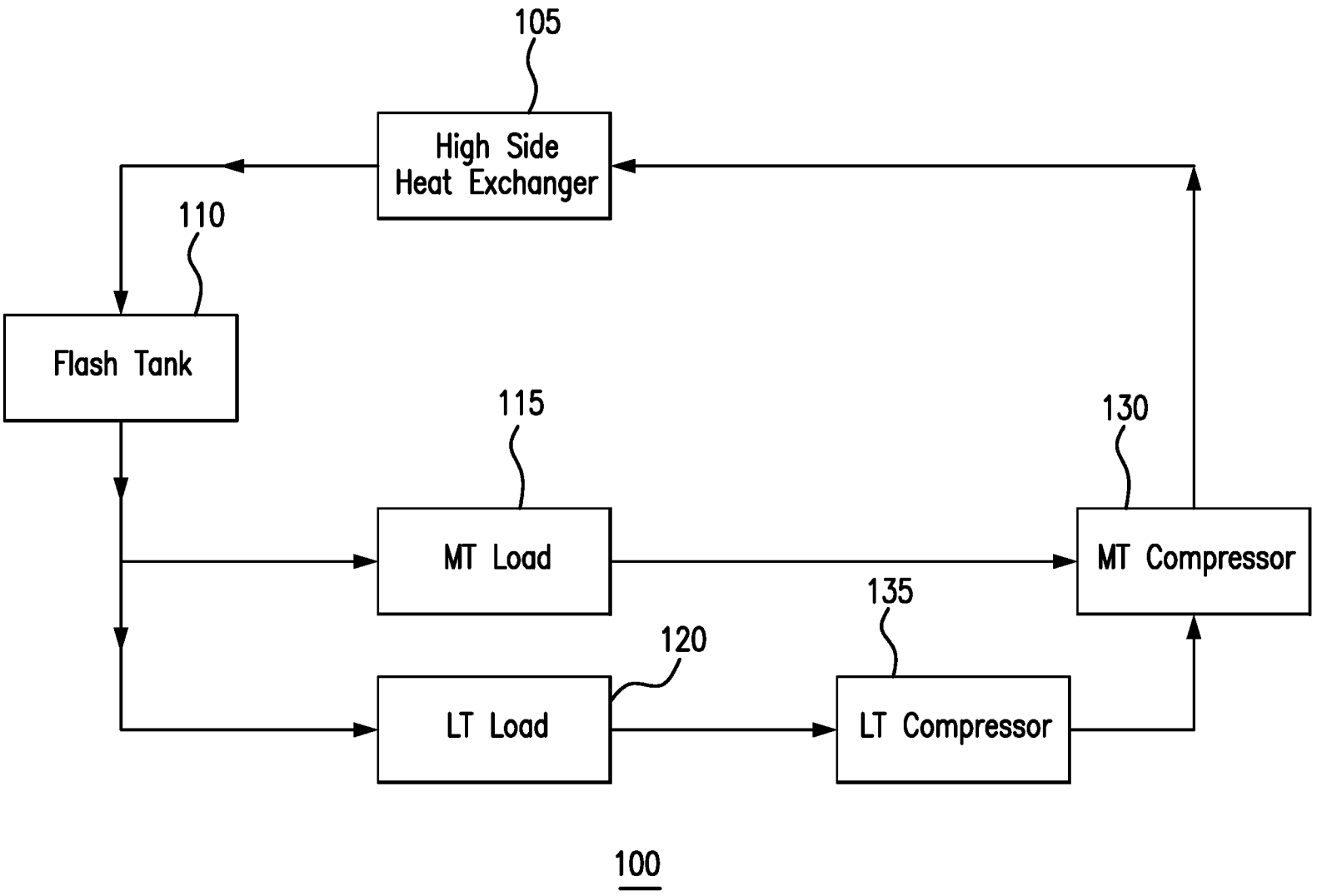
FIG. 1 illustrates an example cooling system.
Figure 2A:
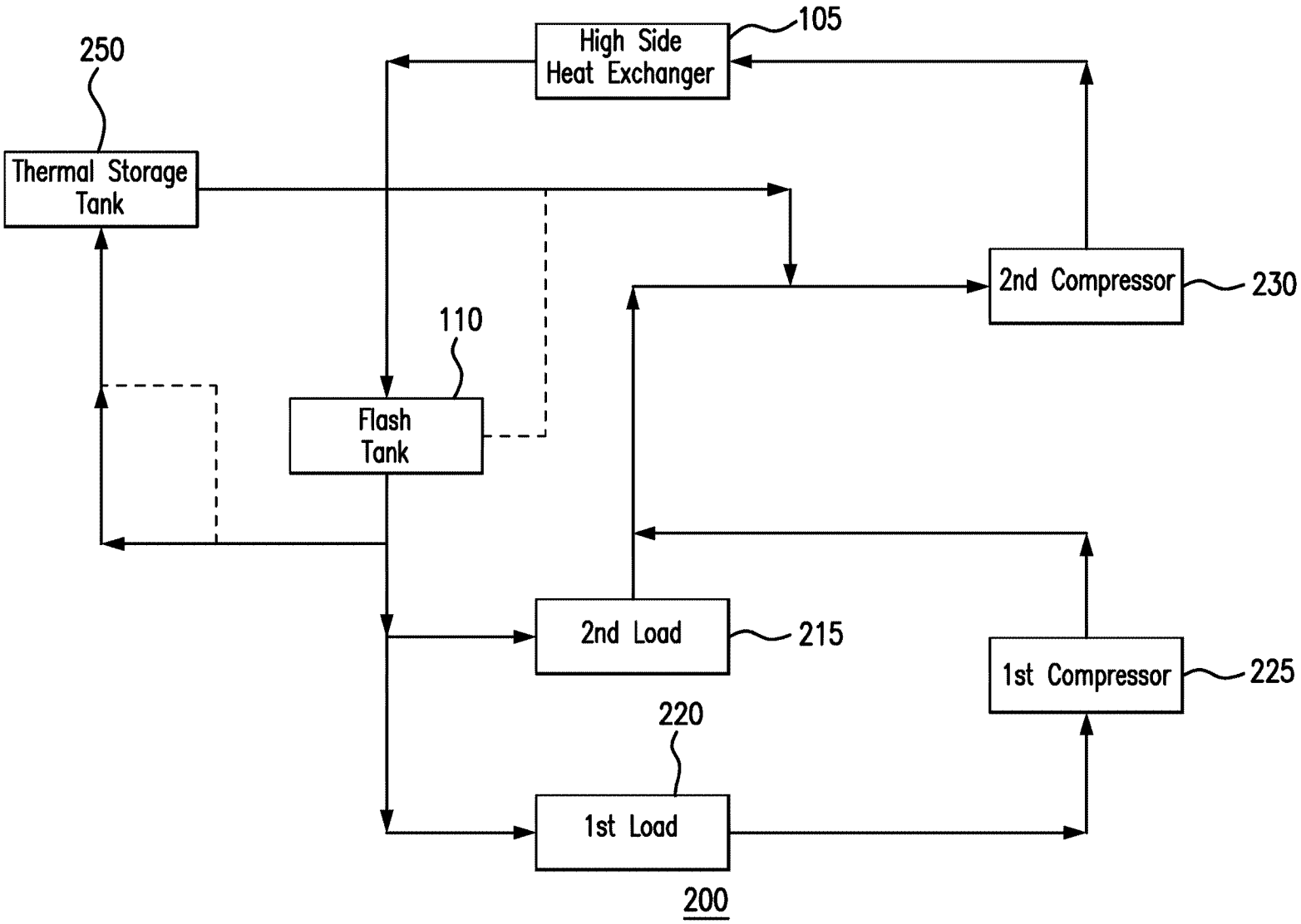
FIG. 2A illustrates an example cooling system including a thermal storage tank, according to certain embodiments.
Figure 2B:
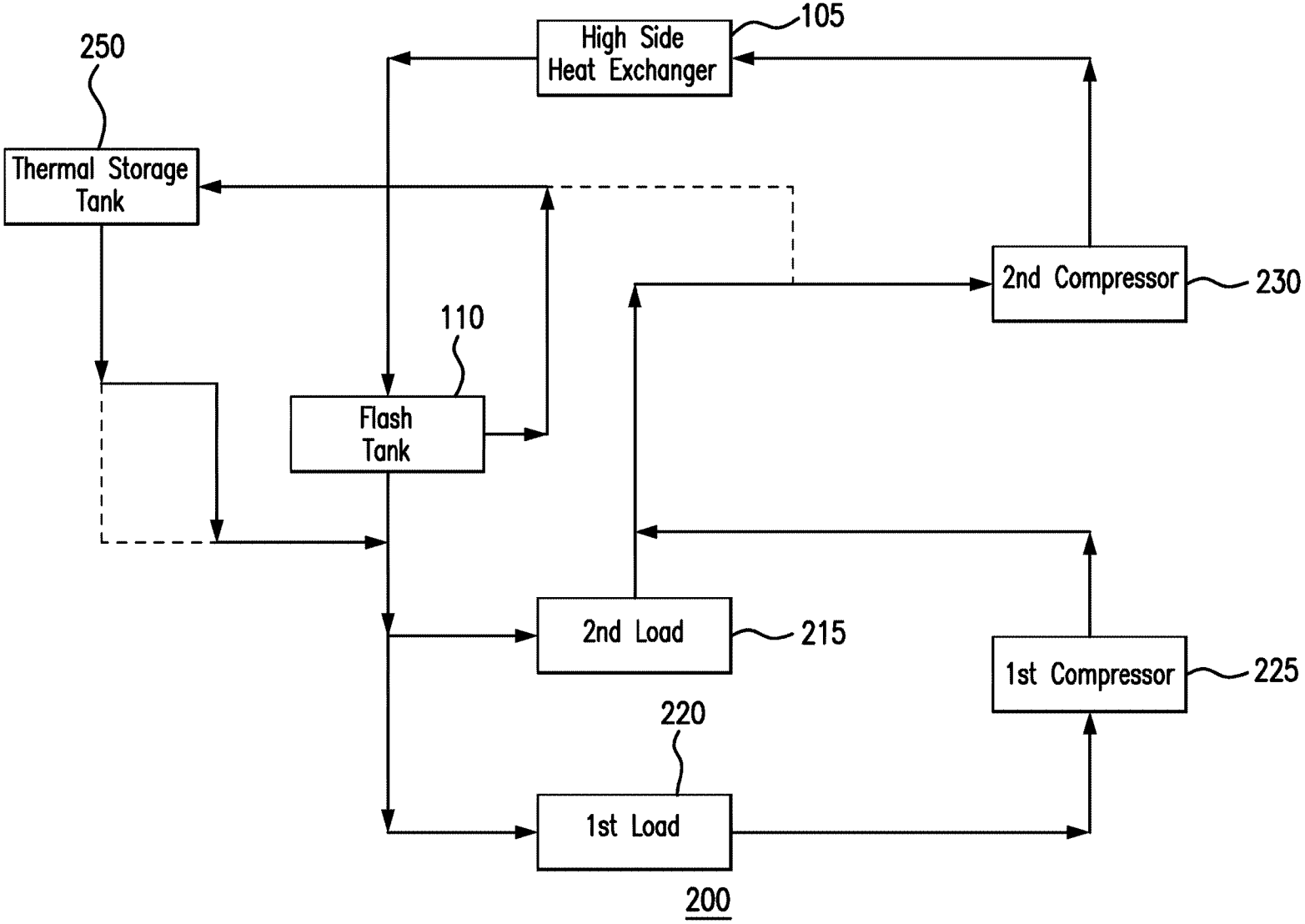
FIG. 2B illustrates an example cooling system including a thermal storage tank, according to certain embodiments.
Figure 3:
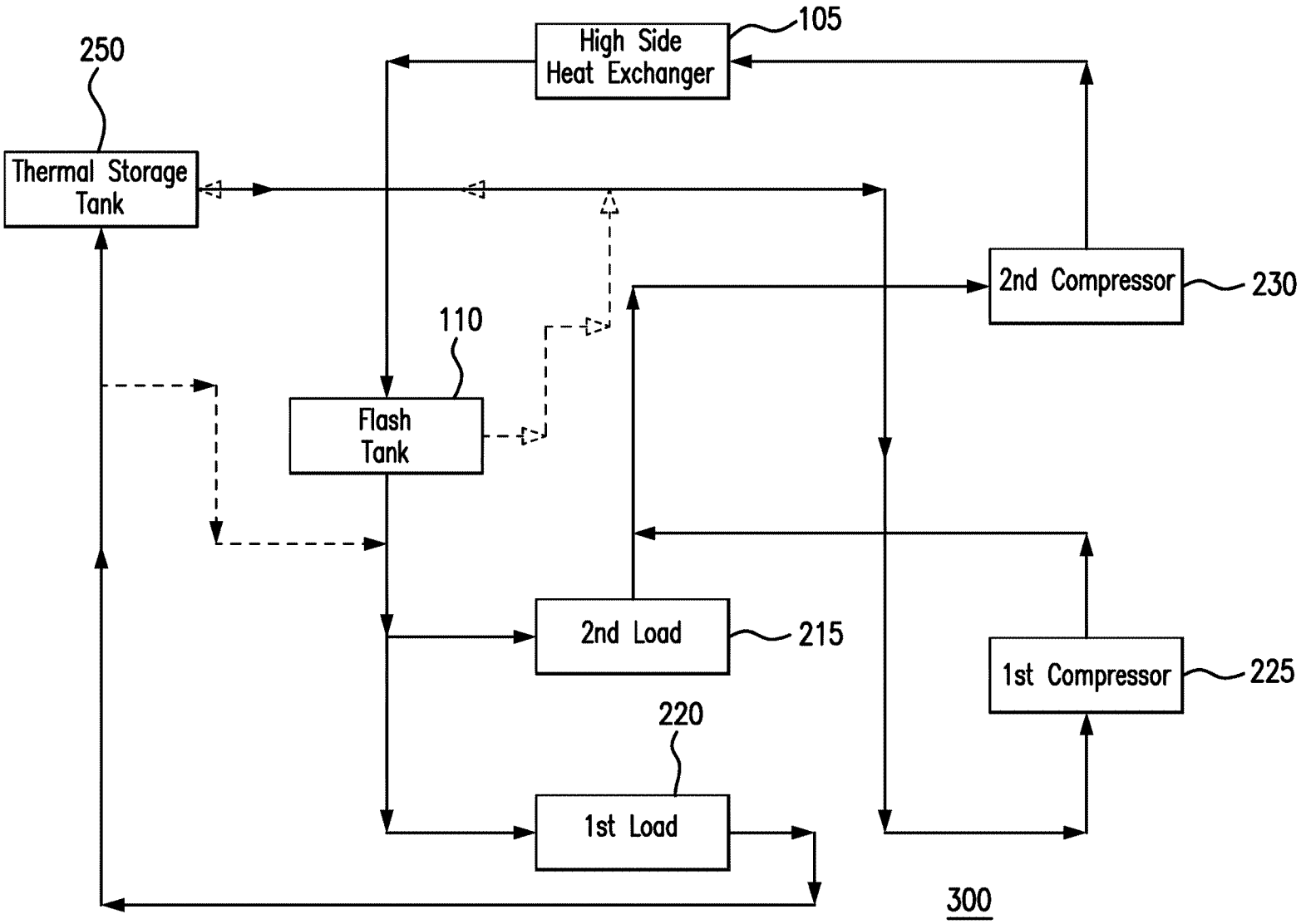
FIG. 3 illustrates an example cooling system including a thermal storage tank, according to certain embodiments.

Embodiments of the present disclosure and its advantages are best understood by referring to FIGS. 1 through 3 of the drawings, like numerals being used for like and corresponding parts of the various drawings.

Cooling systems may cycle a refrigerant to cool various spaces. For example, a refrigeration system may cycle refrigerant to cool spaces near or around refrigeration loads. In certain installations, such as at a grocery store for example, a refrigeration system may include different types of loads. For example, a grocery store may use medium temperature loads and low temperature loads. The medium temperature loads may be used for produce and the low temperature loads may be used for frozen foods. The compressors for these loads may be chained together. For example, the discharge of the low temperature compressor for the low temperature load may be fed into the medium temperature compressor that also compresses the refrigerant from the medium temperature loads. The discharge of the medium temperature compressor is then fed to a high side heat exchanger that removes heat from the compressed refrigerant.

In conventional cooling systems, when there is a power outage, refrigerant in the system absorbs heat from the environment. As a result, refrigerant in the system increases in pressure. Pressure may continue to increase until a valve releases refrigerant from the cooling system to release pressure in the system. As a result, refrigerant from the cooling system may be lost when there is a power outage. Refrigerant may then need to be replaced.

The present disclosure contemplates use of a thermal storage tank to keep refrigerant in the system cool during a power outage. When there is not a power outage, the system may keep the thermal storage tank cold by cycling the refrigerant already in the system through the thermal storage tank.

The system will be described in more detail using FIGS. 1 through 6. FIG. 1 will describe an existing refrigeration system. FIGS. 2A through 5B will describe the refrigeration system with a thermal storage tank. FIG. 6 will describe a method of operating the refrigeration system with a thermal storage tank of FIGS. 2A through 5B.

FIG. 1 illustrates an example cooling system 100. As shown in FIG. 1, system 100 includes a high side heat exchanger 105, a flash tank 110, a medium temperature load 115, a low temperature load 120, a medium temperature compressor 130, and a low temperature compressor 135.

High side heat exchanger 105 may remove heat from a refrigerant. When heat is removed from the refrigerant, the refrigerant is cooled. This disclosure contemplates high side heat exchanger 105 being operated as a condenser, a fluid cooler, and/or a gas cooler. When operating as a condenser, high side heat exchanger 105 cools the refrigerant such that the state of the refrigerant changes from a gas to a liquid. When operating as a fluid cooler, high side heat exchanger 105 cools liquid refrigerant and the refrigerant remains a liquid. When operating as a gas cooler, high side heat exchanger 105 cools gaseous refrigerant and the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building.

Flash tank 110 may store refrigerant received from high side heat exchanger 105. This disclosure contemplates flash tank 110 storing refrigerant in any state such as, for example, a liquid state and/or a gaseous state. Refrigerant leaving flash tank 110 is fed to low temperature load 120 and medium temperature load 115. In some embodiments, a flash gas and/or a gaseous refrigerant is released from flash tank 110. By releasing flash gas, the pressure within flash tank 110 may be reduced. When system 100 loses power, refrigerant of system 100 increases in temperature. As a result, pressure in flash tank 110 increases. As a result, when system 100 loses power, flash tank 110 releases additional flash gas and/or gaseous refrigerant. This results in loss or reduction of refrigerant from system 100 when system 100 loses power.

System 100 may include a low temperature portion and a medium temperature portion. The low temperature portion may operate at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. Refrigerant may flow from flash tank 110 to both the low temperature and medium temperature portions of the refrigeration system. For example, the refrigerant may flow to low temperature load 120 and medium temperature load 115. When the refrigerant reaches low temperature load 120 or medium temperature load 115, the refrigerant removes heat from the air around low temperature load 120 or medium temperature load 115. As a result, the air is cooled. The cooled air may then be circulated such as, for example, by a fan to cool a space such as, for example, a freezer and/or a refrigerated shelf. As refrigerant passes through low temperature load 120 and medium temperature load 115, the refrigerant may change from a liquid state to a gaseous state as it absorbs heat.

Refrigerant may flow from low temperature load 120 and medium temperature load 115 to compressors 130 and 135. This disclosure contemplates system 100 including any number of low temperature compressors 135 and medium temperature compressors 130. The low temperature compressor 135 and medium temperature compressor 130 may increase the pressure of the refrigerant. As a result, the heat in the refrigerant may become concentrated and the refrigerant may become a high pressure gas. Low temperature compressor 135 may compress refrigerant from low temperature load 120 and send the compressed refrigerant to medium temperature compressor 130. Medium temperature compressor 130 may compress refrigerant from low temperature compressor 135 and medium temperature load 115. Medium temperature compressor 130 may then send the compressed refrigerant to high side heat exchanger 105.

As shown in FIG. 1, the discharge of low temperature compressor 135 is fed to medium temperature compressor 130. Medium temperature compressor 130 then compresses the refrigerant from medium temperature load 115 and low temperature compressor 135.

When a power outage occurs, refrigerant in system 100 absorbs heat from the environment and may transition from a liquid to a gas. The components of system 100 however may not be able to operate to remove that heat from the refrigerant due to the power outage. As a result, the pressure of the refrigerant increases, which causes the pressure in system 100 to increase. Pressure may continue to increase until an escape valve releases refrigerant from the system. As a result, refrigerant is lost from system 100, and must be replaced.

FIGS. 2A and 2B illustrate an example cooling system 200 with a thermal storage tank 250. FIG. 2A illustrates the flow of refrigerant in system 200 with power and FIG. 2B illustrates the flow of refrigerant in system 200 without power. As shown in FIGS. 2A and 2B, system 200 includes high side heat exchanger 105, flash tank 110, a first load 220, a second load 215, a first compressor 225, a second compressor 230, and thermal storage tank 250. System 200 includes several components that are also in system 100. These components may operate similarly as they did in system 100. However, the components of system 200 may be configured differently than the components in system 100 to reduce loss of refrigerant during a power outage. In some embodiments of system 200, the first space is at a lower temperature than the second space.

As illustrated in FIG. 2A, when cooling system 200 has power, high side heat exchanger 105 may direct refrigerant to flash tank 110. Flash tank 110 may direct refrigerant to first load 220, second load 215, and/or thermal storage tank 250. Refrigerant may flow from first load 220 to first compressor 225. Second compressor 230 may receive refrigerant from second load 215, first compressor 225, and thermal storage tank 250. Second compressor 230 may direct the refrigerant to high side heat exchanger 105. As a result, system 200 may reduce the extent to which thermal storage tank 250 increases in temperature when system 200 does have power. In certain embodiments, system 200 may reduce the extent to which thermal storage tank 250 increases in temperature without the need for additional hardware or controls.

As illustrated in FIG. 2B, when system 200 does not have power, refrigerant in flash tank 110 absorbs heat and becomes a flash gas. Flash tank 110 releases the flash gas to thermal storage tank 250. Thermal storage tank 250 removes heat from the flash gas and condenses the flash gas into a liquid in some embodiments. In certain embodiments, the condensed liquid returns to flash tank 110. As a result, system 200 may reduce the extent to which refrigerant of system 200 increases in temperature, and thereby increases in pressure, when system 200 does not have power. The less the pressure of the refrigerant increases, the less likely it is for the escape valve to release refrigerant from system 200. As a result, system 200 may reduce loss of refrigerant from system 200 when system 200 does not have power.

As in system 100, flash tank 110 may store refrigerant received from high side heat exchanger 105. This disclosure contemplates flash tank 110 storing refrigerant in any state such as, for example, a liquid state and/or a gaseous state. Flash tank 110 may store the refrigerant from high side heat exchanger 105 and discharge a flash gas. In system 200, refrigerant leaving flash tank 110 may be directed to first load 220, second load 215, and/or thermal storage tank 250. In some embodiments, a flash gas and/or a gaseous refrigerant is released from flash tank 110 to thermal storage tank 250.

Refrigerant may flow from first load 220 and second load 215 to compressors of system 200. This disclosure contemplates system 200 including any number of compressors. In some embodiments, refrigerant from first load 220 flows to first compressor 225. Refrigerant from second load 215 and first compressor 225 flows to second compressor 230. As illustrated in FIG. 2A, when system 200 has power, refrigerant may also flow from thermal storage tank 250 to second compressor 230. First compressor 225 and second compressor 230 may increase the pressure of the refrigerant. As a result, the heat in the refrigerant may become concentrated and the refrigerant may become high pressure gas. First compressor 225 may compress refrigerant from first load 220 and send the compressed refrigerant to second compressor 230. Second compressor 230 may compress refrigerant from first compressor 225 and second load 215. As illustrated in FIG. 2A, when system 200 has power, compressor 230 may also compress refrigerant from thermal storage tank 250. Second compressor 230 may then send the compressed refrigerant to high side heat exchanger 105.

As illustrated in FIG. 2B, when system 200 is without power, thermal storage tank 250 may receive flash gas from flash tank 110, remove heat from the flash gas, and condense the flash gas into a liquid. In certain embodiments, the condensed liquid returns to flash tank 110. As illustrated in FIG. 2A, when system 200 has power, thermal storage tank 250 may receive refrigerant from flash tank 110. The refrigerant received from flash tank 110 may remove heat from thermal storage tank 250. Thermal storage tank 250 may direct the refrigerant to second compressor 230. As a result, in certain embodiments, thermal storage tank 250 may remove heat from the flash gas of cooling system 200 during a power outage and reduce loss of refrigerant from cooling system 200 during a power outage.

This disclosure contemplates system 200 including any number of components. For example, system 200 may include any number of loads 215 and/or 220. As another example, system 200 may include any number of compressors 225 and/or 230. As a further example, system 200 may include any number of thermal storage tanks 250. As yet another example, system 200 may include any number of high side heat exchangers 105 and flash tanks 110. This disclosure also contemplates cooling system 200 using any appropriate refrigerant. For example, cooling system 200 may use carbon dioxide refrigerant.

FIG. 3 illustrates an example cooling system 300 with thermal storage tank 250. As illustrated in FIG. 3, system 300 includes high side heat exchanger 105, flash tank 110, first load 220, second load 215, first compressor 225, second compressor 230, and thermal storage tank 250. System 300 includes several components that are also in system 100. These components may operate similarly as they did in system 100. However, the components of system 300 may be configured differently than the components of system 100 to reduce loss of refrigerant during a power outage. In some embodiments of system 300, the first space is at a lower temperature than the second space. When system 300 has power, refrigerant flows from flash tank 110 to load 220, thermal storage tank 250, and then to compressor 225 along a path represented by solid lines. In some embodiments, when system 300 is without power, refrigerant flows from flash tank 110 to thermal storage tank 250 and then back to flash tank 110 along a path represented by the dashed lines.

As illustrated in FIG. 3, when cooling system 300 has power, high side heat exchanger 105 may direct refrigerant to flash tank 110. Flash tank 110 may direct the refrigerant to first load 220 and/or second load 215. First load 220 may send the refrigerant to thermal storage tank 250. Thermal storage tank 250 may then direct the refrigerant to first compressor 225. Second compressor 230 may receive refrigerant from second load 215 and first compressor 225. Second compressor 230 may direct the refrigerant to high side heat exchanger 105. As a result, system 300 may reduce the extent to which thermal storage tank 250 increases in temperature when system 300 does have power. In certain embodiments, system 300 may reduce the extent to which thermal storage tank 250 increases in temperature without the need for additional hardware or controls.

As illustrated in FIG. 3, when system 300 does not have power, refrigerant in flash tank 110 absorbs heat and becomes a flash gas. Flash tank 110 releases the flash gas to thermal storage tank 250. Thermal storage tank 250 removes heat from the flash gas. After thermal storage tank 250 removes heat from the flash gas and condenses the flash gas into a liquid, in certain embodiments, the condensed liquid returns to flash tank 110. As a result, system 300 may reduce the extent to which refrigerant of system 300 increases in temperature, and thereby increases in pressure, when system 300 does not have power. The less the pressure of the refrigerant increases, the less likely it is for the escape valve to release refrigerant from system 200. As a result, system 300 may reduce loss of refrigerant from system 300 when system 300 does not have power.

As in system 100, flash tank 110 may store refrigerant received from high side heat exchanger 105. In certain embodiments, when a power outage is determined to be occurring, flash tank 110 also stores condensed liquid from thermal storage tank 250. This disclosure contemplates flash tank 110 storing refrigerant in any state such as, for example, a liquid state and/or a gaseous state. In system 300, refrigerant leaving flash tank 110 is fed to first load 220 and/or second load 215 when system 300 has power. Refrigerant from flash tank 110 is fed to first load 220, second load 215 and/or thermal storage tank 250 when system 300 does not have power. As in system 100, flash tank 110 may store the refrigerant from high side heat exchanger 105 and discharge a flash gas.

Refrigerant may flow from second load 215 and/or thermal storage tank 250 to compressors of system 300. This disclosure contemplates system 300 including any number of compressors. In some embodiments, refrigerant from second load 215 and thermal storage tank 250 may be directed to first compressor 225 and/or second compressor 230. First compressor 225 and second compressor 230 may increase the pressure of the refrigerant. As a result, the heat in the refrigerant may become concentrated and the refrigerant may become high pressure gas. First compressor 225 may compress refrigerant from thermal storage tank 250 and send the compressed refrigerant to second compressor 230. Second compressor 230 may compress refrigerant from first compressor 225 and second load 215. Second compressor 230 may then send the compressed refrigerant to high side heat exchanger 105.

As illustrated in FIG. 3, when system 300 is without power, thermal storage tank 250 may receive flash gas from flash tank 110, remove heat from the flash gas, and condense the flash gas into a liquid. In certain embodiments, the condensed liquid returns to flash tank 110. As further illustrated in FIG. 3, when system 300 has power, thermal storage tank 250 may receive refrigerant from first load 220. Refrigerant from first load 220 may remove heat from thermal storage tank 250. Thermal storage tank 250 may then direct the refrigerant to first compressor 225. As a result, in certain embodiments, thermal storage tank 250 may remove heat from flash gas of cooling system 300 during a power outage and reduce loss of refrigerant from cooling system 300 during a power outage.

This disclosure contemplates system 300 including any number of components. For example, system 300 may include any number of first load 220 and/or second load 225. As another example, system 300 may include any number of compressors 225 and/or 230. As a further example, system 300 may include any number of thermal storage tanks 250. As yet another example, system 300 may include any number of high side heat exchangers 105 and flash tanks 110. This disclosure also contemplates cooling system 300 using any appropriate refrigerant. For example, cooling system 300 may use carbon dioxide refrigerant.

Figure 4:
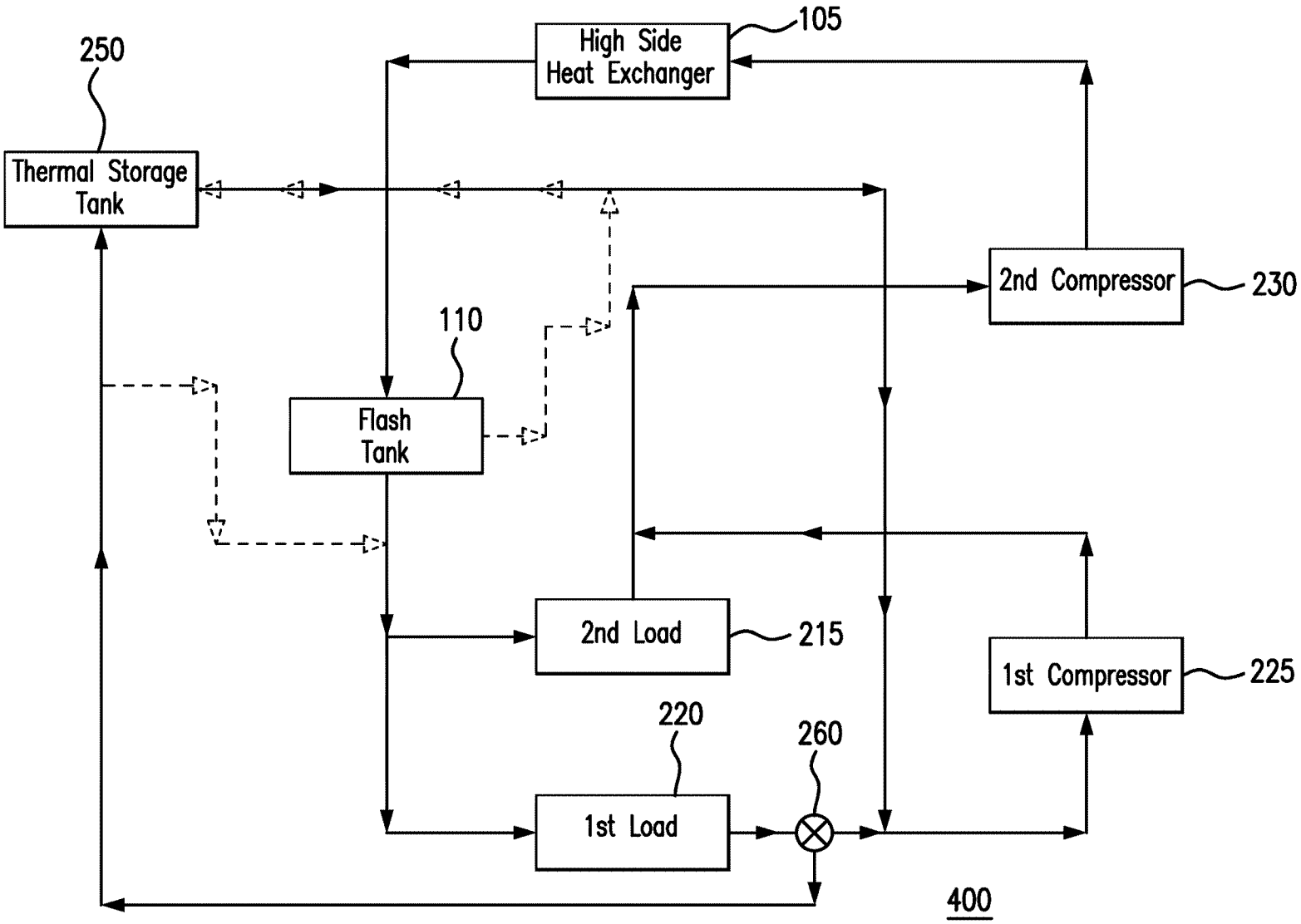
FIG. 4 illustrates an example cooling system including a thermal storage tank, according to certain embodiments.

FIG. 4 illustrates an example cooling system 400 with thermal storage tank 250. As shown in FIG. 4, system 400 includes high side heat exchanger 105, flash tank 110, first load 220, second load 215, first compressor 225, second compressor 230, thermal storage tank 250, and a valve 260. System 400 includes several components that are also in system 100. These components may operate similarly as they did in system 100. However, the components of system 400 may be configured differently than the components of system 100 to reduce loss of refrigerant during a power outage. In some embodiments, the first space is at a lower temperature than the second space. When system 400 has power, refrigerant flows from flash tank 110 to load 220, through valve 260, to thermal storage tank 250, and then to compressor 225 along a path represented by solid lines. In some embodiments, when system 400 is without power, refrigerant flows from flash tank 110 to thermal storage tank 250 and then back to flash tank 110 along a path represented by dotted lines.

As illustrated in FIG. 4, when system 400 has power, high side heat exchanger 105 may direct refrigerant to flash tank 110. Flash tank 110 may direct refrigerant to first load 220 and/or second load 215. First load 220 may direct the refrigerant to first compressor 225 and/or the thermal storage tank 250. Thermal storage tank 250 may direct the refrigerant to first compressor 225. Second compressor 230 may receive refrigerant from first compressor 225 and second load 215. Second compressor 230 may direct the refrigerant to high side heat exchanger 105. As a result, system 400 may reduce the extent to which thermal storage tank 250 increases in temperature when system 400 has power. In certain embodiments, system 400 may reduce the extent to which thermal storage tank 250 increases in temperature without the need for additional hardware or controls.

As illustrated in FIG. 4, when cooling system 400 does not have power, refrigerant in flash tank 110 absorbs heat and becomes a flash gas. Flash tank 110 releases the flash gas to thermal storage tank 250. Thermal storage tank 250 removes heat from the flash gas and condenses the flash gas into a liquid. In certain embodiments, the condensed liquid returns to flash tank 110. As a result, system 400 may reduce the extent to which refrigerant of system 400 increases in temperature, and thereby increases in pressure, when system 400 does not have power. The less the pressure of the refrigerant increases, the less likely it is for the escape valve to release refrigerant from system 200. As a result, system 400 may reduce loss of refrigerant from system 400 when system 400 does not have power.

As in system 100, flash tank 110 may store refrigerant received from high side heat exchanger 105. In certain embodiments, when a power outage is determined to be occurring, flash tank 110 also stores condensed liquid from thermal storage tank 250. This disclosure contemplates flash tank 110 storing refrigerant in any state such as, for example, a liquid state and/or a gaseous state. In system 400, refrigerant leaving flash tank 110 may be directed to first load 220 and/or second load 215. In some embodiments, flash gas from flash tank 110 is directed to thermal storage tank 250 when system 400 is without power. As in system 100, flash tank 110 may store the refrigerant from high side heat exchanger 105 and discharge a flash gas.

Refrigerant may flow from first load 220 and/or second load 215 to compressors of system 400. This disclosure contemplates system 400 including any number of compressors. In some embodiments, refrigerant from first load 220 travels to thermal storage tank 250 and/or first compressor 225. First compressor 225 and second compressor 230 may increase the pressure of the refrigerant. As a result, the heat in the refrigerant may become concentrated and the refrigerant may become high pressure gas. First compressor 225 may compress refrigerant from first load 220 and/or thermal storage tank 250 and send the compressed refrigerant to second compressor 230. Second compressor 230 may compress refrigerant from first compressor 225 and second load 215. Second compressor 230 may then send the compressed refrigerant to high side heat exchanger 105.

As illustrated in FIG. 4, when system 400 is without power, thermal storage tank 250 may receive flash gas from flash tank 110, remove heat from the flash gas, and condense the flash gas into a liquid. In certain embodiments, the condensed liquid may return to flash tank 110. When system 400 has power, thermal storage tank 250 may receive refrigerant from first load 220. First load 220 may remove heat from thermal storage tank 250. Thermal storage tank 250 may then direct the refrigerant to first compressor 225. As a result, in certain embodiments thermal storage tank 250 may reduce the loss of refrigerant from cooling system 400 during a power outage.

In some embodiments, system 400 includes valve 260. When a power outage is determined not to be occurring, valve 260 may direct the refrigerant from first load 220 to first compressor 225. When a power outage is determined to be occurring, valve 260 may direct at least a portion of the refrigerant from first load 220 to thermal storage tank 250.

This disclosure contemplates system 400 including any number of components. For example, system 400 may include any number of loads 215 and/or 220. As another example, system 400 may include any number of compressors 225 and/or 230. As a further example, system 400 may include any number of thermal storage tanks 250. As yet another example, system 400 may include any number of high side heat exchangers 105 and flash tanks 110. This disclosure also contemplates cooling system 400 using any appropriate refrigerant. For example, cooling system 400 may use a carbon dioxide refrigerant.

Figure 5A:
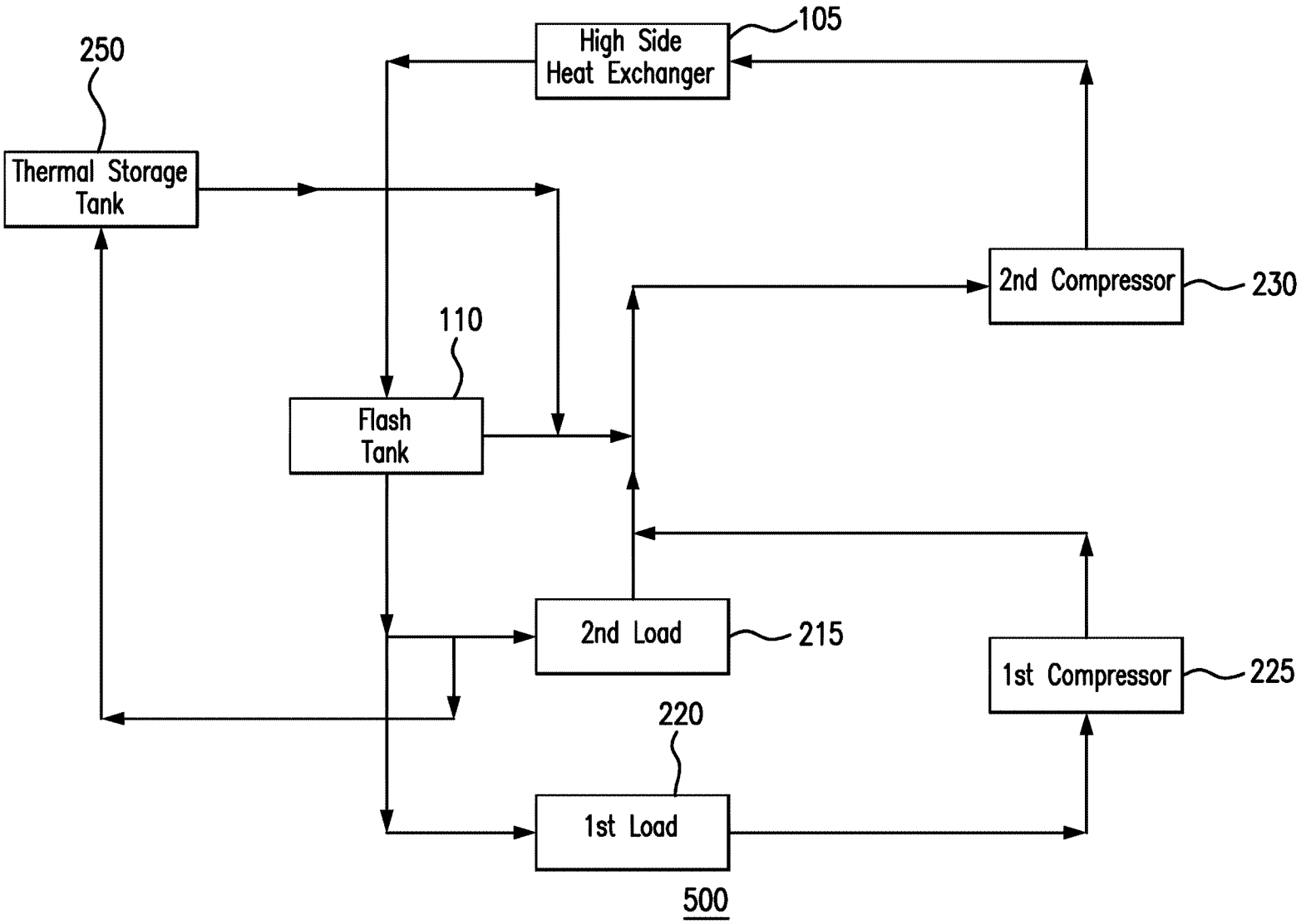
FIG. 5A illustrates an example cooling system including a thermal storage tank, according to certain embodiments.
Figure 5B:
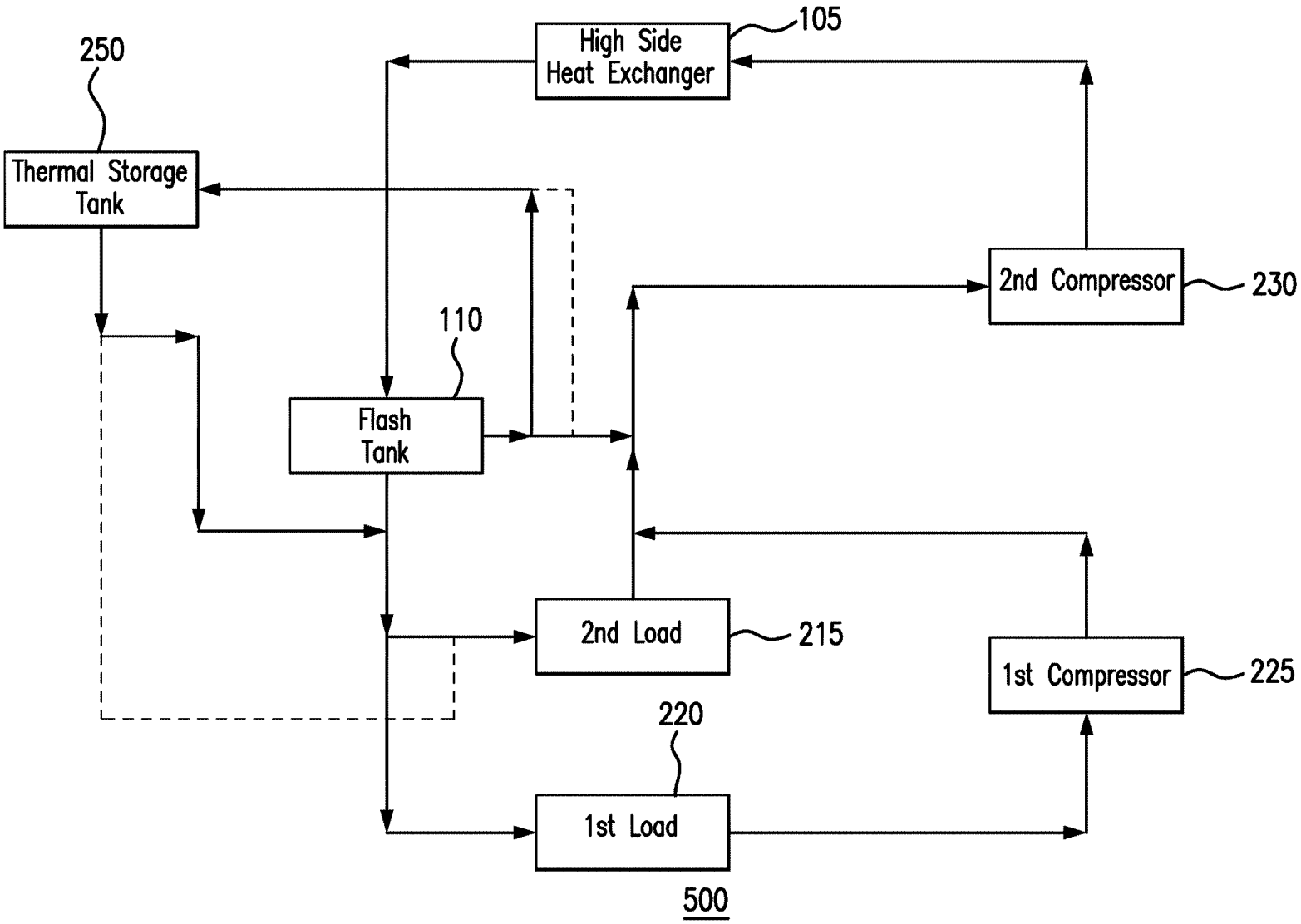
FIG. 5B illustrates an example cooling system including a thermal storage tank, according to certain embodiments.
Figure 6:
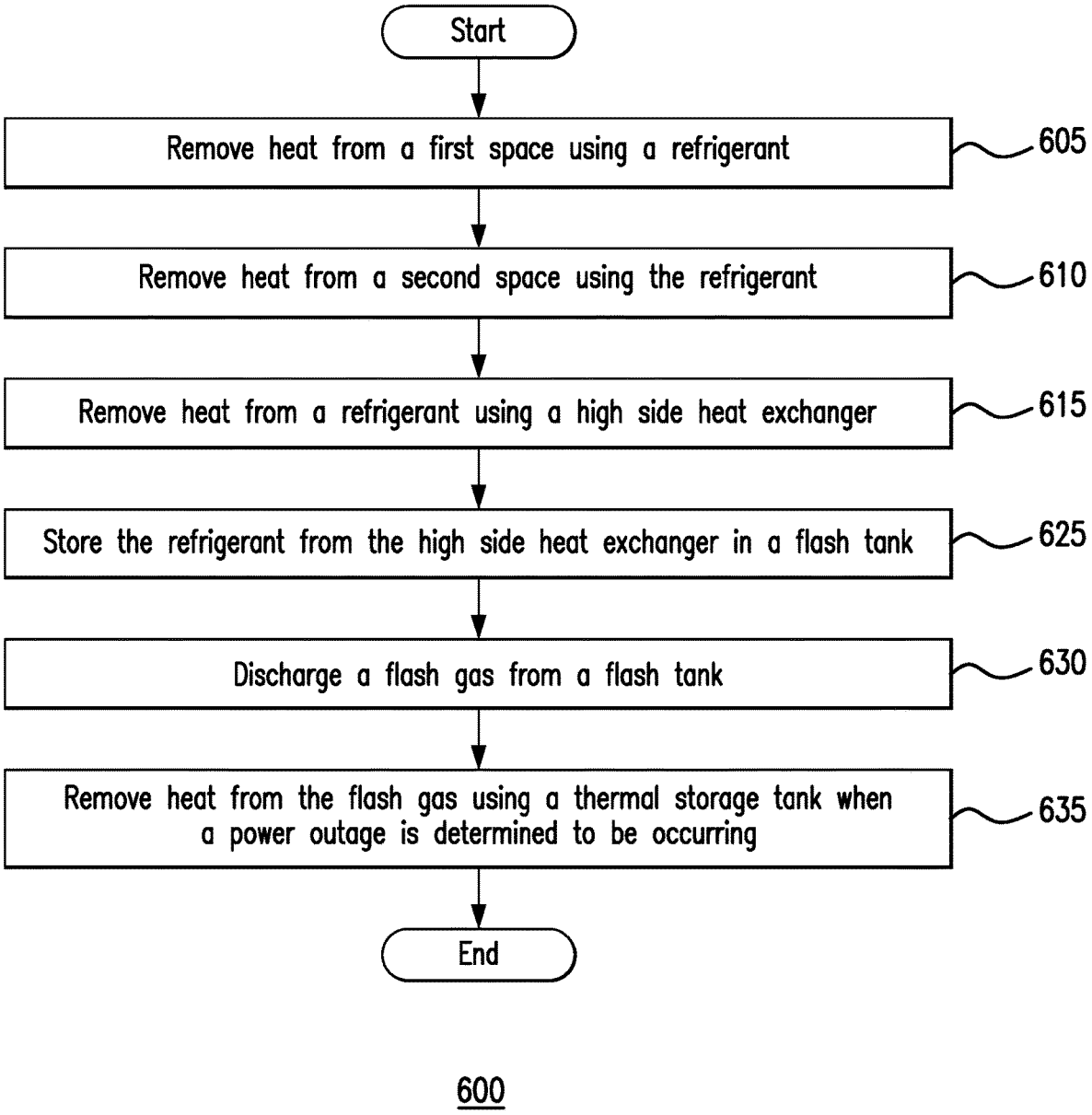
FIG. 6 is a flowchart illustrating a method of operating the example cooling system of FIGS. 2A through 5B.

FIGS. 5A and 5B illustrate example cooling system 500 with thermal storage tank 250. FIG. 5A illustrates the flow of refrigerant in system 500 when there is power and FIG. 5B illustrates the flow of refrigerant in system 500 without power. As shown in FIGS. 5A and 5B, system 500 includes high side heat exchanger 105, flash tank 110, first load 220, second load 215, first compressor 225, second compressor 230 and thermal storage tank 250. System 500 includes several components that are also in system 100. These components may operate similarly as they did in system 100. However, the components of system 500 may be configured differently than the components of system 100 to prevent loss of refrigerant during a power outage. In some embodiments of system 500, the first space is at a lower temperature than the second space.

As illustrated in FIG. 5A, when system 500 has power, flash tank 110 directs refrigerant to first load 220, second load 215 and/or thermal storage tank 250. The refrigerant from flash tank 110 removes heat from thermal storage tank 250. Thermal storage tank 250 then directs the refrigerant to second compressor 230.

As illustrated in FIG. 5B, when system 500 does not have power, refrigerant in flash tank 110 absorbs heat and becomes a flash gas. Flash tank 110 releases the flash gas to thermal storage tank 250. Thermal storage tank 250 removes heat from the flash gas and condenses the flash gas into a liquid. In certain embodiments, the condensed liquid returns to flash tank 110. As a result, system 500 may reduce the extent to which refrigerant of system 500 increases in temperature, and thereby increases in pressure, when system 500 does not have power. The less the pressure of the refrigerant increases, the less likely it is for the escape valve to release refrigerant from system 200. As a result, system 500 may reduce loss of refrigerant from system 500 when system 500 does not have power.

As in system 100, flash tank 110 may store a refrigerant received from high side heat exchanger 105. In certain embodiments, when a power outage is determined to be occurring, flash tank 110 also stores condensed liquid from thermal storage tank 250. This disclosure contemplates flash tank 110 storing refrigerant in any state such as, for example, a liquid state and/or a gaseous state. Refrigerant leaving flash tank 110 may be fed to first load 220, second load 215 and/or thermal storage tank 250. As illustrated in FIG. 5B, when a power outage is determined to be occurring, flash tank 110 may release a flash gas to thermal storage tank 250. As illustrated in FIG. 5A, when a power outage is determined not to be occurring, flash tank 110 may release refrigerant to first load 220, second load 215, and/or thermal storage tank 250. In such embodiments, flash tank 110 may release refrigerant to second compressor 230. As in system 100, flash tank 110 may store the refrigerant from high side heat exchanger 105 and discharge a flash gas.

Refrigerant may flow from first load 220 and second load 215 to compressors of system 500. This disclosure contemplates system 500 including any number of compressors. In some embodiments, refrigerant from first load 220, second load 215, thermal storage tank 250, and/or flash tank 110 is directed to first compressor 225 and/or second compressor 230. First compressor 225 and second compressor 230 may increase the pressure of the refrigerant. As a result, the heat in the refrigerant may become concentrated and the refrigerant may become high pressure gas. Refrigerant from first load 220 may flow to first compressor 225. First compressor 225 may compress the refrigerant from first load 220. As illustrated in FIG. 5A, when system 500 has power, second compressor 230 may receive refrigerant from second load 215, first compressor 225, flash tank 110, and thermal storage tank 250.

As illustrated in FIG. 5B, when system 500 is without power, thermal storage tank 250 may receive flash gas from flash tank 110, remove heat from the flash gas, and condense the flash gas into a liquid. In certain embodiments, the condensed liquid returns to flash tank 110. As illustrated in FIG. 5A, thermal storage tank 250 may, when a power outage is determined not to be occurring, receive refrigerant from flash tank 110. The refrigerant received from flash tank 110 may remove heat from thermal storage tank 250. Thermal storage tank 250 may direct the refrigerant to second compressor 230. As a result, in certain embodiments, thermal storage tank 250 may remove heat from the flash gas of cooling system 500 during a power outage and reduce loss of refrigerant from cooling system 500 during a power outage.

Thermal storage tank 250 may be of any size, shape, or material suitable to remove heat from the flash gas when a power outage is determined to be occurring and/or release heat to the refrigerant of systems 200, 300, 400, and/or 500 when a power outage is determined not to be occurring. In certain embodiments, when systems 200, 300, 400, and/or 500 are without power, thermal storage tank 250 may be of any size, shape, or material suitable to remove heat from the flash gas for a period of six hours without loss of refrigerant from systems 200, 300, 400, and/or 500. For example, in certain embodiments, thermal storage tank 250 may have dimensions of two cubic feet. As another example, thermal storage tank 250 may have a thermal storage capacity of 3.3 percent of the total capacity of the cooling system. As yet another example, thermal storage tank 250 may have the capacity to store 300 kbtu/h.

This disclosure contemplates system 500 including any number of components. For example, system 500 may include any number of loads 215 and/or 220. As another example, system 500 may include any number of compressors 225 and/or 230. As a further example, system 500 may include any number of thermal storage tanks 250. As yet another example, system 500 may include any number of high side heat exchangers 105 and flash tanks 110. This disclosure also contemplates cooling system 500 using any appropriate refrigerant. For example, cooling system 500 may use carbon dioxide refrigerant.

FIG. 6 is a flowchart illustrating a method 600 of operating the example cooling systems 200, 300, 400, and 500 of FIGS. 2A through 5. Various components of systems 200, 300, 400, and 500 perform the steps of method 600. In certain embodiments, performing method 600 may reduce loss of refrigerant from cooling systems 200, 300, 400, and 500 when a power outage is occurring.

First load 220 may begin by removing heat from a first space proximate to first load 220 using a refrigerant from flash tank 110, in step 605. In step 610, second load 215 may remove heat from a second space proximate to second load 215 using the refrigerant from flash tank 110. In step 615, high side heat exchanger 105 may remove heat from the refrigerant. In step 625, flash tank 110 may store the refrigerant from high side heat exchanger 105. In step 630, flash tank 110 may discharge a flash gas. In step 635, thermal storage tank 250 may remove heat from the flash gas discharged from flash tank 110 when a power outage is determined to be occurring. In certain embodiments of method 600, the first space is at a lower temperature than the second space.

Modifications, additions, or omissions may be made to method 600 depicted in FIG. 6. Method 600 may include more, fewer, or other steps. For example, steps may be performed in parallel or in any suitable order. While discussed as various components of cooling system 600 performing the steps, any suitable component or combination of components of system 600 may perform one or more steps of the method.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A system comprising:
- a high side heat exchanger configured to remove heat from a refrigerant;
- a flash tank configured to:
  - store the refrigerant from the high side heat exchanger; and
  - discharge a flash gas;
- a first load configured to use the refrigerant from the flash tank to remove heat from a first space proximate to the first load;
- a second load configured to use the refrigerant from the flash tank to remove heat from a second space proximate to the second load;
- a first compressor;
- a second compressor configured to compress the refrigerant from the second load and the first compressor; and
- a thermal storage tank configured, when a power outage is determined to be occurring, to:
  - receive the flash gas from the flash tank; and
  - remove heat from the flash gas;
- wherein, the thermal storage tank is further configured, when the power outage is determined not to be occurring, to:
  - direct the refrigerant to the first compressor, the first compressor configured to compress the refrigerant from the thermal storage tank.

2. The system of claim 1,
- wherein, the thermal storage tank is further configured, when the power outage is determined to be occurring, to:
  - receive the refrigerant from the first load.

3. The system of claim 1, wherein the first compressor is further configured to compress the refrigerant from one or both of the first load and the thermal storage tank.

4. The system of claim 1, wherein the first space is at a lower temperature than the second space.

5. The system of claim 3, further comprising a valve configured, when the power outage is determined not to be occurring, to direct the refrigerant from the first load to the first compressor.

6. A method comprising:
- removing heat from a first space proximate to a first load using a refrigerant from a flash tank;
- removing heat from a second space proximate to a second load using the refrigerant from the flash tank;
- compressing the refrigerant from a thermal storage tank using a first compressor;
- compressing the refrigerant from the second load and the first compressor using a second compressor;
- removing heat from the refrigerant using a high side heat exchanger;
- storing the refrigerant from the high side heat exchanger in the flash tank;
- discharging the flash gas from the flash tank;
- removing heat from the flash gas using a thermal storage tank when a power outage is determined to be occurring; and
- directing the refrigerant from the thermal storage tank to the first compressor when the power outage is determined not to be occurring.

7. The method of claim 6, further comprising, when the power outage is determined to be occurring, directing the refrigerant from the first load to the thermal storage tank using a valve.

8. The method of claim 6, wherein the first space is at a lower temperature than the second space.

9. The method of claim 7, further comprising, when the power outage is determined not to be occurring, directing the refrigerant from the first load to the first compressor using the valve.

10. A system comprising:
- a flash tank configured to:
  - store a refrigerant; and
  - discharge a flash gas;
- a first load configured to use the refrigerant from the flash tank to remove heat from a first space proximate to the first load;
- a second load configured to use the refrigerant from the flash tank to remove heat from a second space proximate to the second load;
- a first compressor configured to compress the refrigerant from a thermal storage tank; and
- a second compressor configured to compress the refrigerant from the second load and the first compressor;
- a thermal storage tank configured, when a power outage is determined to be occurring, to:
  - receive a flash gas from the flash tank; and
  - remove heat from the flash gas;
- wherein the thermal storage tank is configured, when the power outage is determined not to be occurring, to:
  - direct the refrigerant to the first compressor, the first compressor further configured to compress the refrigerant from the thermal storage tank.

11. The system of claim 10, wherein the first compressor is further configured to compress the refrigerant from one or both of the first load and the thermal storage tank.

12. The system of claim 10, wherein the first space is at a lower temperature than the second space.

13. The system of claim 11, further comprising a valve configured, when the power outage is determined not to be occurring, to direct the refrigerant from the first load to the first compressor.

* * * * *